US012146243B2

(12) United States Patent
Nie et al.

(10) Patent No.: US 12,146,243 B2
(45) Date of Patent: Nov. 19, 2024

(54) TWISTING MACHINE FOR AUTOMATIC DONNING

(71) Applicant: YICHANG JINGWEI TEXTILE MACHINERY CO., LTD., Hubei (CN)

(72) Inventors: Jian Nie, Hubei (CN); Pihua Zhang, Hubei (CN); Ming Zhang, Hubei (CN); Yanwei Zhang, Hubei (CN); Lei Wu, Hubei (CN); Yuchao Yan, Hubei (CN); Yongming Li, Hubei (CN); Longfei Zhang, Hubei (CN); Qingqing Lv, Hubei (CN); Huanian Yang, Hubei (CN)

(73) Assignee: YICHANG JINGWEI TEXTILE MACHINERY CO., LTD. (CN)

( * ) Notice: Subject to any disclaimer, the term of this patent is extended or adjusted under 35 U.S.C. 154(b) by 65 days.

(21) Appl. No.: 18/086,289

(22) Filed: Dec. 21, 2022

(65) Prior Publication Data

US 2024/0125010 A1 Apr. 18, 2024

(30) Foreign Application Priority Data

Oct. 13, 2022 (CN) ..... 202211251190.5

(51) Int. Cl.
*D01H 1/18* (2006.01)
*D01H 1/20* (2006.01)

(52) U.S. Cl.
CPC ..... *D01H 1/18* (2013.01); *D01H 1/20* (2013.01)

(58) Field of Classification Search
CPC ..... D01H 9/10; D01H 9/18; D01H 9/182; D01H 1/18; D01H 1/183; D01H 1/10; D01H 1/166
See application file for complete search history.

(56) References Cited

U.S. PATENT DOCUMENTS 3,154,909 A * 11/1964 Urano ..... D01H 9/10 57/271
3,946,547 A * 3/1976 Salmoiraghi ..... D01H 9/182 57/274

(Continued)

FOREIGN PATENT DOCUMENTS

CN 212270321 U * 1/2021
CN 114000232 * 2/2022

(Continued)

OTHER PUBLICATIONS

English translation of CN 114000232, obtained via espacenet.com (last visited May 10, 2024) (Year: 2024).*

(Continued)

*Primary Examiner* — Patrick J. Lynch

(57) ABSTRACT

A twisting machine for automatic donning is provided. The twisting machine includes an outer yarn branch rail arranged at the middle position of the twisting machine, wherein the outer yarn branch rail is positioned above the twisting machine, so as to successively drive the outer yarn carrier assembly to deliver the outer yarn winding package by suspending; the twisting machine further includes an inner yarn branch rail arranged at the both sides of the twisting machine, the inner yarn branch rail is positioned above the twisting machine, so as to successively drive the inner yarn carrier assembly to deliver the inner yarn winding package by suspending.

9 Claims, 13 Drawing Sheets

(56) References Cited

U.S. PATENT DOCUMENTS

| | | | | | |
|---|---|---|---|---|---|
| 4,932,198 | A * | 6/1990 | Eisenhauer | D02G 3/285 | 57/352 |
| 4,934,132 | A * | 6/1990 | Marzoli | D01H 9/046 | 57/267 |
| 5,189,872 | A * | 3/1993 | Mima | B65H 67/0405 | 57/58.49 |
| 5,272,864 | A * | 12/1993 | Suzuki | D01H 9/10 | 57/264 |
| 5,586,428 | A * | 12/1996 | Asai | D01H 9/10 | 57/261 |
| 2010/0199625 | A1* | 8/2010 | Leupers | D01H 1/10 | 57/354 |
| 2013/0074468 | A1* | 3/2013 | Guggemos | D01H 1/244 | 57/271 |

FOREIGN PATENT DOCUMENTS

| | | | | | |
|---|---|---|---|---|---|
| CN | 217378135 | * | 9/2022 | | |
| DE | 3931738 | A1 * | 4/1991 | D01H 9/182 | |
| EP | 1502975 | A2 * | 2/2005 | B65H 59/22 | |
| WO | WO-2016083944 | A1 * | 6/2016 | B65H 73/00 | |

OTHER PUBLICATIONS

English translation of CN217378135, obtained via espacenet.com (last visited May 10, 2024). (Year: 2024).*

* cited by examiner

TWISTING MACHINE FOR AUTOMATIC DONNING

CROSS-REFERENCE TO RELATED APPLICATION

This application claims priority from the Chinese patent application 202211251190.5 filed Oct. 13, 2022, the content of which is incorporated herein in the entirety by reference.

TECHNICAL FIELD

The present disclosure relates to the technical field of the components for twisting machine, in particular to a twisting machine for automatic donning.

BACKGROUND

Existing twisting and weaving factories make donning mainly in manual way, but due to long donning time, low efficiency and big labor intensity arising form their expansion in scale, this way has become an urgent problem for various enterprises. There is a technical solution on robotic donning with AGV (Automated Guided Vehicle), such as a China patent CN111996627A named an automatic donning for twisting machine, but the donning efficiency provided in this solution is still low; moreover, its control is difficult, and the robot has the weak ability to dodge operators, thus often cause many disruptions to the operator's work. There is also a technical solution on automatic donning and doffing, but this solution still needs to make manual donning after doffing, such as a China patent CN112011863A named an automatic doffing system for twisting production. This technical field demands a solution that can be adopted to don yarn in large scale and improve donning efficiency with fairly low labor intensity of operators.

SUMMARY

The technical problem to be solved by the present disclosure consists in effectuation of large-scale automatization for donning and low labor intensity of operators, therefor we provide a twisting machine for automatic donning.

In order to solve the above technical problem, the technical scheme adopted in the present disclosure is as follows:

A twisting machine for automatic donning, comprising an outer yarn branch rail and an inner yarn branch rail, wherein the outer yarn branch rail is arranged at the middle position of a twisting machine, the outer yarn branch rail is positioned above the twisting machine, so as to successively drive an outer yarn carrier assembly to convey an outer yarn winding package by suspending;

the inner yarn branch rail is arranged at the both sides of the twisting machine, the inner yarn branch rail is positioned above the twisting machine, so as to successively drive an inner yarn carrier assembly to convey an inner yarn winding package by suspending.

In a preferred embodiment, a yarn shelving plate is further arranged on a machine frame of the twisting machine, and the shelving plate is used to place a small-diameter outer yarn winding package;

a fixed frame is further arranged on the machine frame, a tube seat is arranged on the fixed frame, and the tube seat is used to place the small-diameter outer yarn winding package.

In a preferred embodiment, the outer yarn carrier assembly is configured to be an outer yarn seated suspending carrier assembly structured in the relation that an articulating connection rod is provided with a suspending wheel assembly, which is suspended on the outer yarn branch rail or an in-air conveying rail, the articulating connection rod is used to articulate and connect a plurality of the outer yarn carrier assemblies with each other, the lower part of the articulating connection rod is connected to a disc-shaped outer yarn seat, the outer yarn seat is arranged obliquely, and a columnar structure used to mount the outer yarn winding package is arranged on the outer yarn seat;

the both sides of the outer yarn seat are provided with outer yarn suspending frames, which are connected with the articulating connection rod, and a bobbin base is further arranged on the both sides of the outer yarn seat.

In a preferred embodiment, an outer yarn guiding rail is arranged on the machine frame, and an outer yarn guiding wheel is arranged on the outer yarn seat; when the outer yarn seated suspending carrier assembly moves to the position of the twisting machine, the outer yarn guiding wheel enters the outer yarn guiding rail, and holds up the outer yarn seat of the outer yarn seated suspending carrier assembly to keep it in an incline state;

when the outer yarn carrier assembly runs to the station corresponding to the twisting machine, it constitutes a carriage of the twisting machine, and the carriage is used to carry the outer yarn winding package for twisting operation.

In a preferred embodiment, the inner yarn carrier assembly is structured in the relation that an articulating connection rod is provided with a suspending wheel assembly, which is suspended on the inner yarn branch rail or an in-air conveying rail, the articulating connection rod is used to articulate and connect a plurality of the inner yarn carrier assemblies with each other, the lower part of the articulating connection rod is connected to a hugging arm by means of a vertical bar, an opening is arranged at the bottom of the hugging arm, the hugging arm is used to carry the inner yarn winding package, and a structure for placing bobbins is arranged on the hugging arm.

In a preferred embodiment, the inner yarn carrier assembly is structured in the relation that an articulating connection rod is provided with a suspending wheel assembly, which is suspended on the inner yarn branch rail or an in-air conveying rail, the articulating connection rod is used to articulate and connect a plurality of the inner yarn carrier assemblies with each other, the lower part of the articulating connection rod is connected to a four bar linkage by means of a connecting rod, a draw spring is arranged between the two connecting rods approached by the four bar linkage at the bottom, the two connecting rods within the four bar linkage are connected to a first suspending rod and a second suspending rod, respectively, and barbs are arranged on the bottoms of the first suspending rod and the second suspending rod;

the draw spring is configured to direct the first suspending rod and the second suspending rod to part from each other.

In a preferred embodiment, a sliding rail is arranged on a machine frame, a sliding frame is slidingly connected with the sliding rail, a spindle bucket and a twisting mechanism are arranged on the sliding frame, and the sliding frame is configured to slide out from or into one side of the twisting machine.

In a preferred embodiment, a driving device is further arranged on the machine frame, and the driving device is connected to a sliding main shaft by means of a transmission mechanism and drives the sliding main shaft to rotate; a sliding gear is arranged on the sliding main shaft, a sliding rack is arranged on the sliding frame, the sliding rack meshes with the sliding gear, so that the sliding frame is configured to slide out from or into one side of the twisting machine.

In a preferred embodiment, an inner yarn branch rail-lifting section capable of ascending and descending is arranged on the inner yarn branch rail corresponding to the twisting machine, so that the inner yarn carrier assembly ascends and descends in its entirety;

the inner yarn branch rail-lifting section is fixedly connected with a lifting rail, a lifter guiding wheel is arranged on a supporting frame, the lifting rail is slidingly connected with the lifter guiding wheel, and there is also a driving device provided, which drives the inner yarn branch rail-lifting section to ascend and descend by means of a transmission mechanism, and the transmission mechanism includes a gear rack mechanism, an air cylinder mechanism or a winch mechanism;

there is also a travel sensor provided to detect an ascending and descending distance;

the inner yarn carrier assembly is structured in the relation that an articulating connection rod is provided with a suspending wheel assembly, which is suspended on the inner yarn branch rail or an in-air conveying rail, the articulating connection rod is used to detachably articulate and connect a plurality of the inner yarn carrier assemblies with each other, and the articulating connection rod is connected with a carrier of the inner yarn winding package.

In a preferred embodiment, an inner yarn branch rail-lifting section capable of ascending and descending is arranged on the inner yarn branch rail corresponding to the twisting machine, so that the inner yarn carrier assembly ascends and descends in its entirety;

the length and the unit quantity of the inner yarn carrier assembly correspond to the length and the unit quantity of the twisting machine;

the inner yarn branch rail-lifting section is fixedly connected with a lifting rail, a lifter guiding wheel is arranged on a supporting frame, and the lifting rail is slidingly connected with the lifter guiding wheel;

a lifting main shaft is arranged on the supporting frame, the lifting main shaft rotationally stands on the supporting frame, a lifter driving motor is further arranged on the supporting frame, the lifter driving motor drives the lifting main shaft to rotate, a winching wheel is further arranged on the lifting main shaft, a winching belt is wound on the winching wheel, the end of the winching belt is connected with the inner yarn branch rail-lifting section, and the winching wheel rotates to drive the inner yarn branch rail-lifting section to ascend and descend.

For the twisting machine for automatic donning according to the present disclosure, the forementioned structure enables the outer yarn winding package and the inner yarn winding package to be delivered high-efficiently in large scale by suspending and conveying, so as to largely reduce the labor intensity of operators and dramatically improve production efficiency.

BRIEF DESCRIPTION OF THE DRAWINGS

We shall further describe the present disclosure in combination with the drawings and examples as follows.

Figure 1:
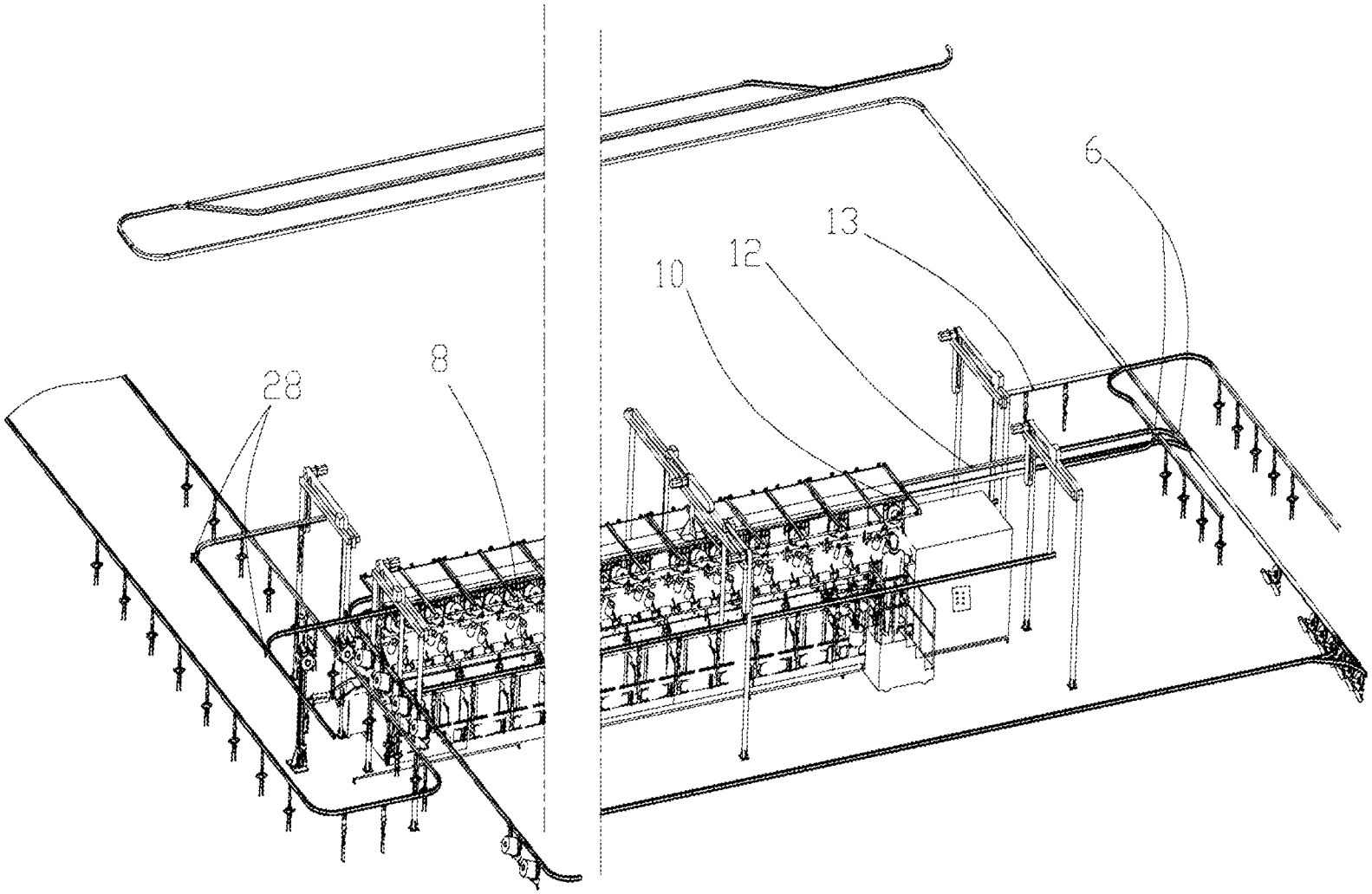
FIG. 1 is a 3D stereogram of the twisting area according to the present disclosure.

Wherein, outer yarn preparation area 1, inner yarn preparation area 2, in-air conveying rail 3, original yarn delivery area 4, twisting area 5, diverging-and-merging switch 6, Weaving area 7, twisting machine 8, fixed frame 9, machine frame 10, outer yarn guiding rail 101, carriage 11, outer yarn branch rail 12, inner yarn branch rail 13, inner yarn branch rail-lifting section 131, yarn shelving plate 14, tube seat 15, small-diameter outer yarn winding package 16, ascending trolley 17, ground wheel 171, footstep 172, spindle bucket 18, ascending trolley guiding rail 19, guide pulley mechanism 20, inner yarn suspending device 21, connecting rod 211, four bar linkage 212, draw spring 213, first suspending rod 214, second suspending rod 215, barbs 216, travel driving unit 22, trigger sensor 23, brake 24, outer yarn carrier assembly 25, twisting mechanism 26, rotating swing arm 27, sort reader 28, sliding rack 29, sliding gear 30, sliding main shaft 31, transmission mechanism 32, driving device 33, sliding rail 34, sliding frame 35, supporting frame 36, beam 37, lifting rail 38, lifter guiding wheel 39, lifter driving motor 40, lifting main shaft 41, winching wheel 42, winching belt 43, travel sensor 44, inner yarn hugging suspending device 45, suspending wheel assembly 451, articulating connection rod 452, vertical bar 453, outer yarn suspending base 454, hugging arm 455, opening 4551, a structure for placing bobbins 4552, ball head 456, opening groove 457, outer yarn seated suspending carrier assembly 46, outer yarn suspending frames 461, outer yarn seat 462, columnar structure 4621, bobbin bases 463, driving device 400, transmission mechanism 401, carrier 402, outer yarn guiding wheel 464, outer yarn winding package 47, inner yarn winding package 48

DETAILED DESCRIPTION OF SOME EMBODIMENTS

Example 1

Figure 2:
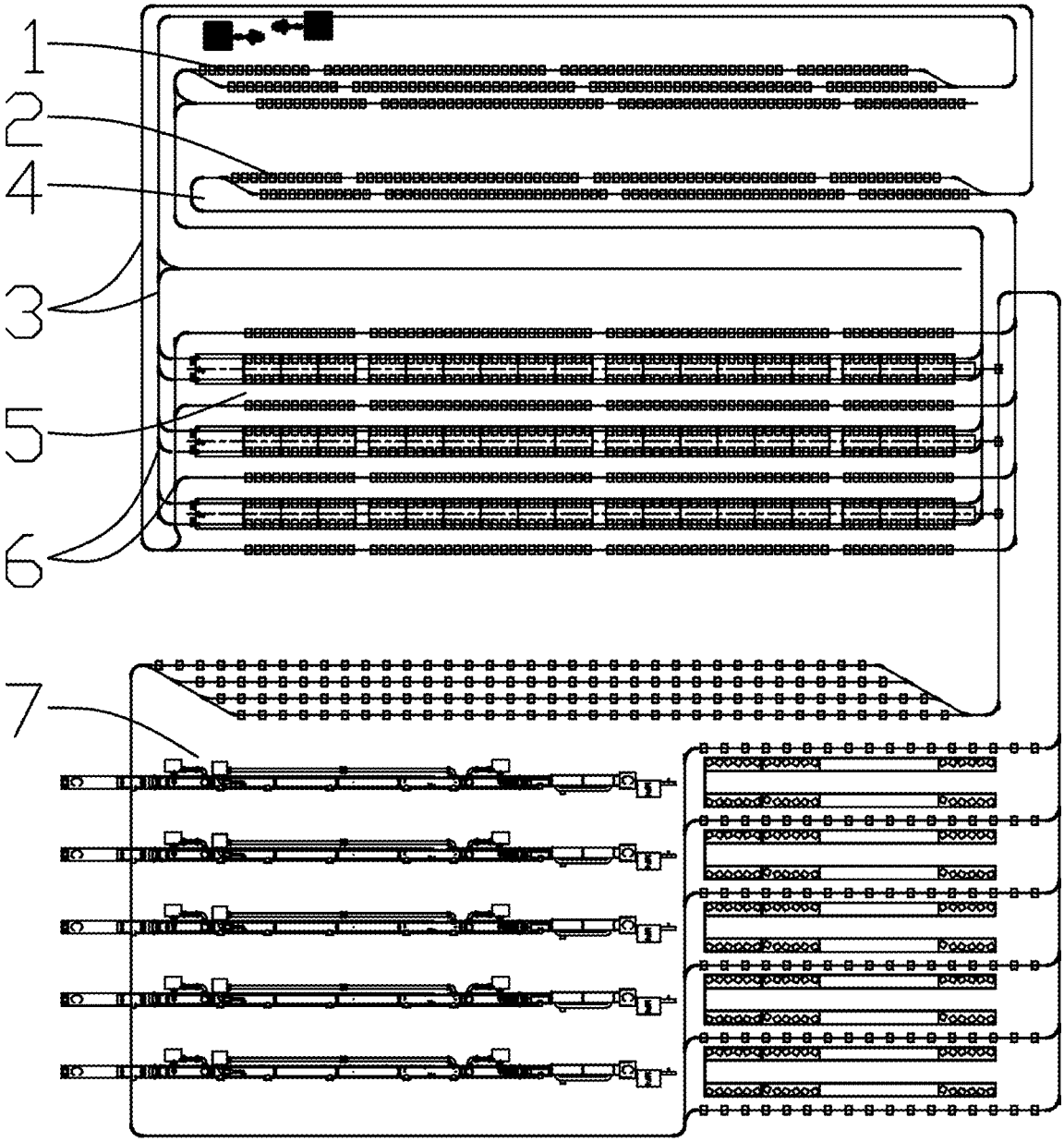
FIG. 2 shows a top view of the overall structure of the present disclosure.

As shown in FIGS. 1 and 2, a twisting machine for automatic donning includes the outer yarn branch rail 12 arranged at the middle position of the twisting machine 8, wherein the outer yarn branch rail 12 is positioned above the twisting machine 8, so as to successively drive the outer yarn carrier assembly 25 to convey the outer yarn winding package 47 by suspending.

The twisting machine for automatic donning further includes the inner yarn branch rails 13 arranged at the both sides of the twisting machine 8, the inner yarn branch rail 13 is positioned above the twisting machine 8, so as to successively drive the inner yarn carrier assembly to convey the inner yarn winding package 48 by suspending.

Figure 3:
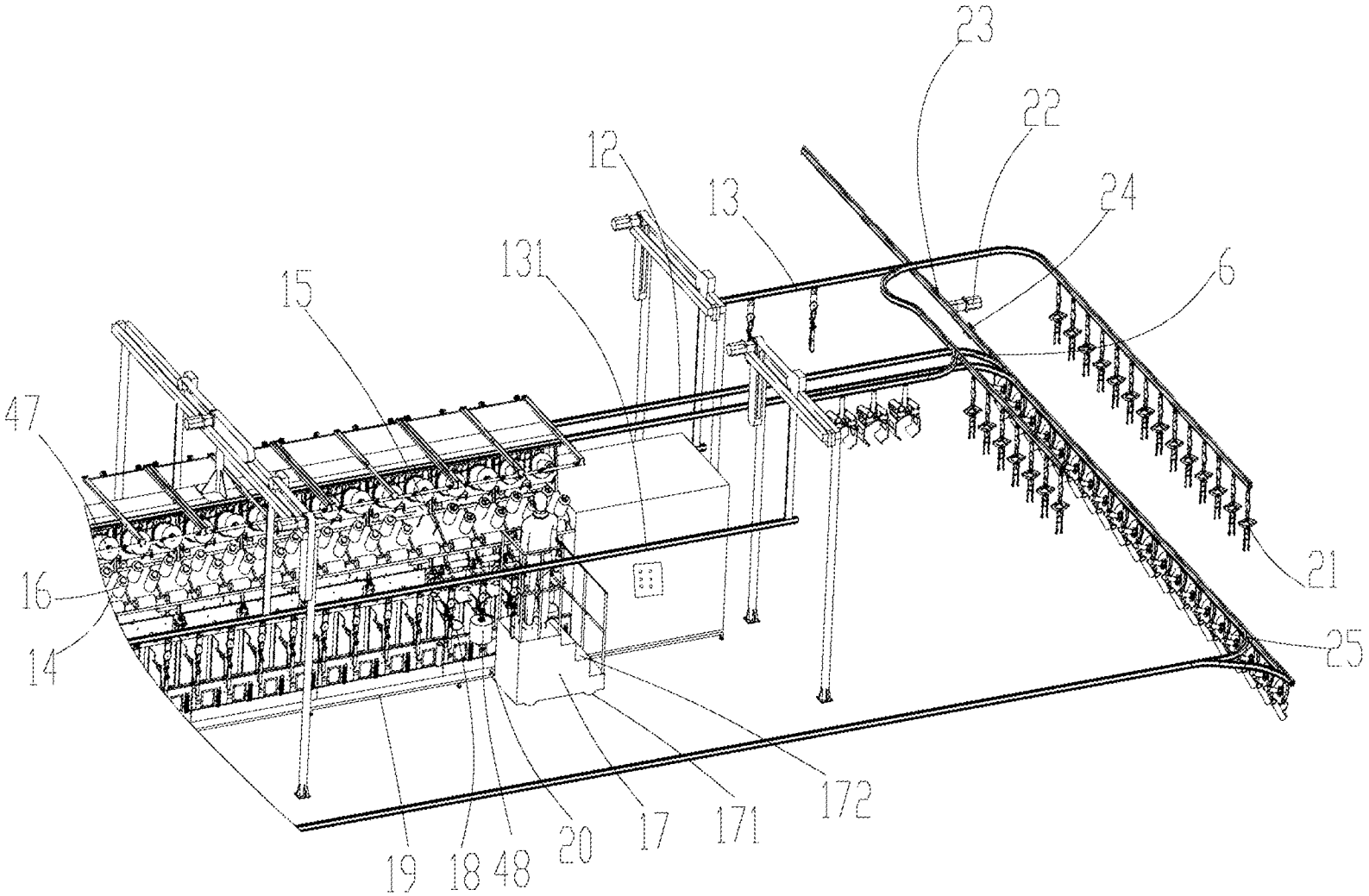
FIG. 3 shows a local enlarged view of the twisting area according to the present disclosure.
Figure 4:
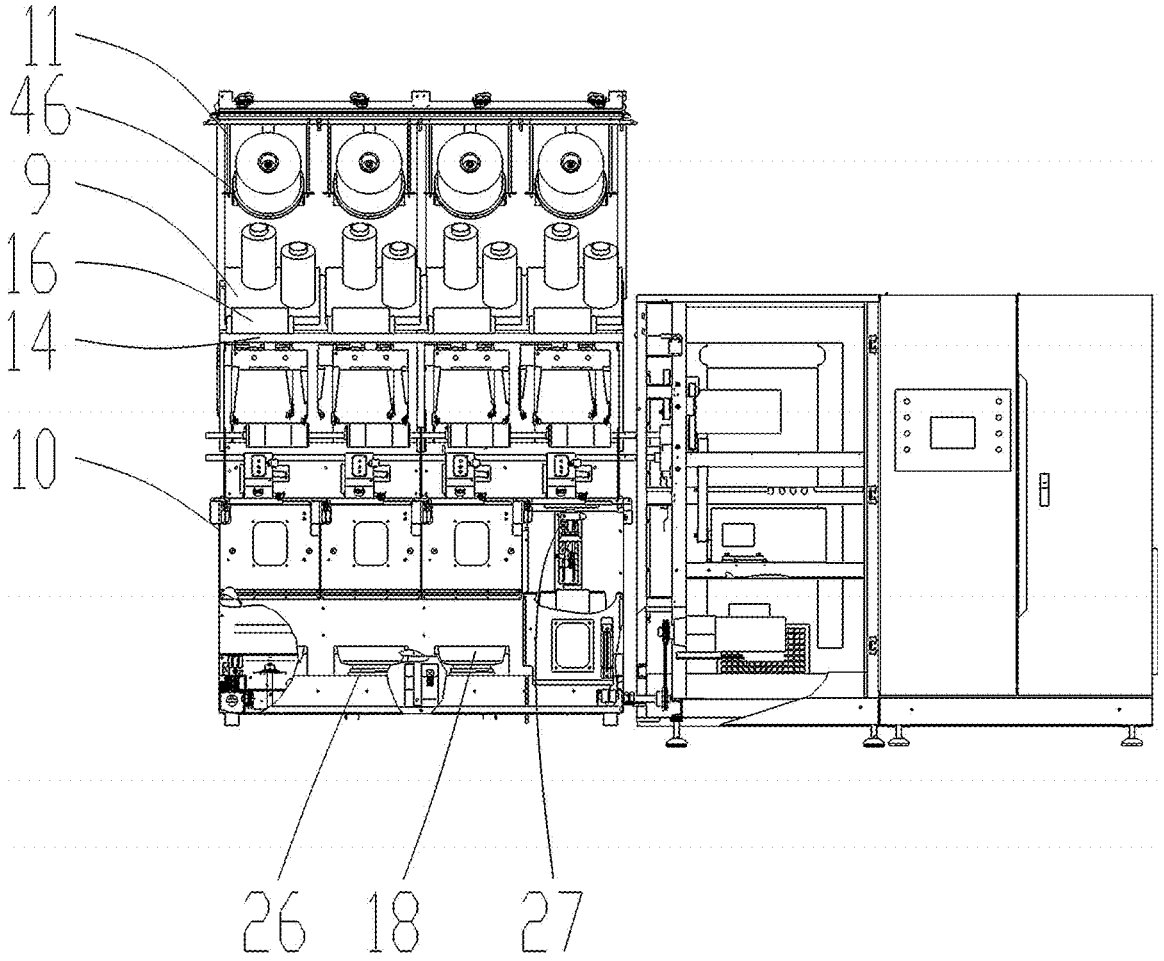
FIG. 4 shows a local front view of the twisting machine according to the present disclosure.

As a preferred solution shown in FIGS. 3 and 4, the yarn shelving plate 14 is further arranged on the machine frame 10 of the twisting machine 8, and the shelving plate is used to place the small-diameter outer yarn winding package 16.

The fixed frame 9 is further arranged on the machine frame 10, the tube seat 15 is arranged on the fixed frame 9, and the tube seat is used to place the small-diameter outer yarn winding package 16, which refers to the outer yarn winding package that has been used once. Removing the small-diameter outer yarn winding package 16 for priority use enables the outer yarn winding package 47 to be simultaneously replaced.

Figure 10:
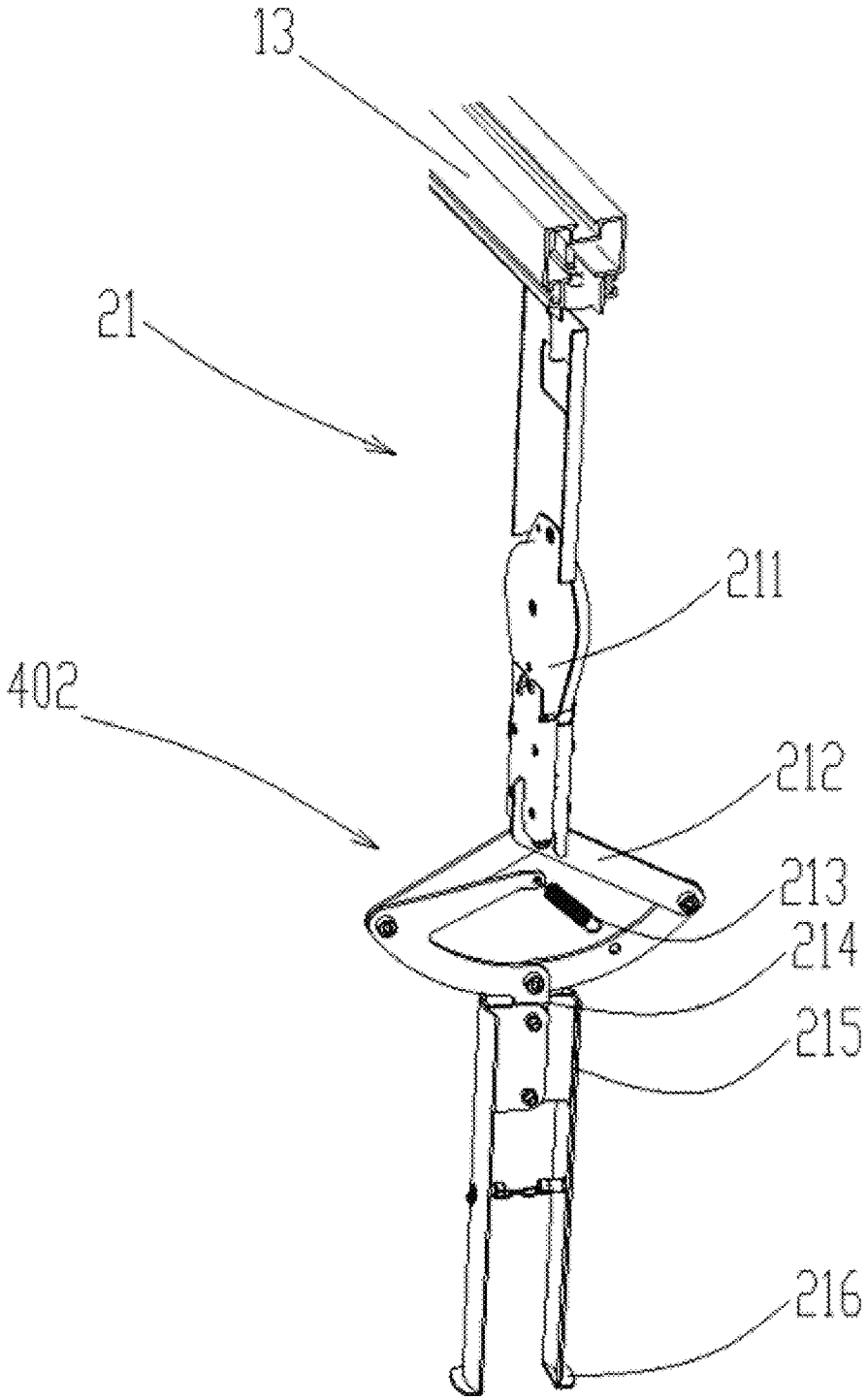
FIG. 10 is a 3D stereogram of the inner yarn suspending device according to the present disclosure.

As a preferred solution shown in FIG. 10, the outer yarn carrier assembly 25 is configured to be the outer yarn seated suspending carrier assembly 46 structured in the relation that the articulating connection rod 452 is provided with the suspending wheel assembly 451, which is suspended on the outer yarn branch rail 12 or the in-air conveying rail 3, the articulating connection rod 452 is used to articulate and connect a plurality of the outer yarn carrier assemblies 25 with each other, the lower part of the articulating connection rod 452 is connected to the disc-shaped outer yarn seat 462, the outer yarn seat 462 is arranged obliquely, and the columnar structure 4621 used to mount the outer yarn winding package 47 is arranged on the outer yarn seat 462; when the outer yarn carrier assemblies 25 are connected into an entirety, the travel driving unit 22 arranged on the in-air conveying rail 3 can drive all the outer yarn carrier assemblies 25 to operate by means of a friction wheel structure. During operation, the trigger sensor 23 performs automatic control, the trigger sensor 23 may be a limit switch, a photoelectric sensor or a laser code scanner. The in-air conveying rail 3 is also provided with the brake 24 used to enable the outer yarn carrier assembly 25 to stop precisely.

The both sides of the outer yarn seat 462 are provided with the outer yarn suspending frames 461, which are connected with the articulating connection rod 452, and the bobbin bases 463 are further arranged on the both sides of the outer yarn seat 462. The outer yarn suspending frame 461 also enables the balance of the outer yarn seat 462.

As a preferred solution shown in FIGS. 3 and 4, when the outer yarn carrier assembly 25 runs to the station corresponding to the twisting machine 8, it constitutes the carriage 11 of the twisting machine 8, and the carriage 11 is used to carry the outer yarn winding package 47 for twisting operation.

The drive mode of the inner yarn carrier assembly is the same as that of the outer yarn carrier assembly 25, and both are driven by the travel driving unit 22 under the function of the friction wheel structure. The trigger sensor 23 and the brake 24 are also used for automatic control and braking.

Figure 9:
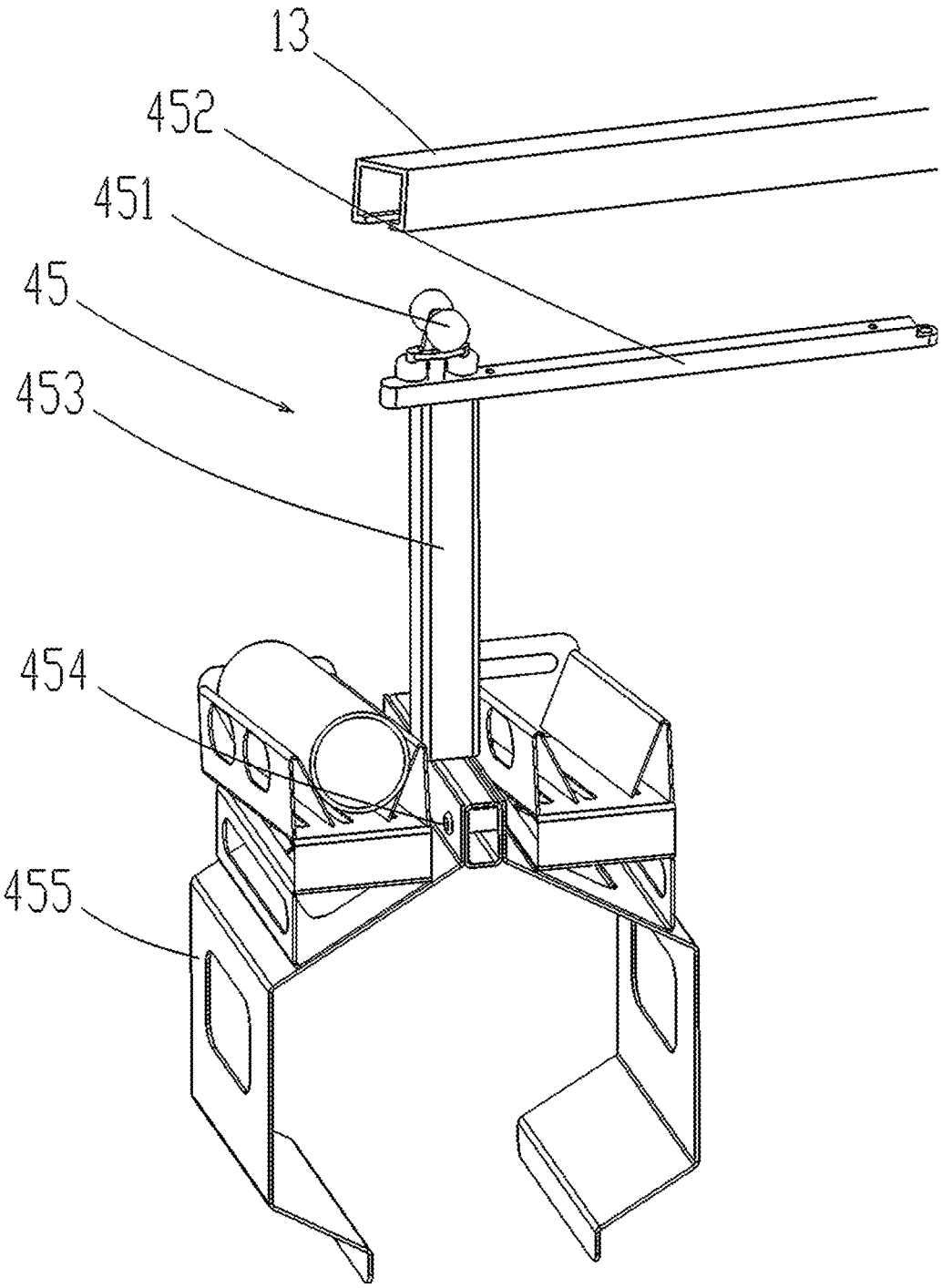
FIG. 9 is a 3D stereogram of the inner yarn hugging suspending device according to the present disclosure.

As a preferred solution shown in FIG. 9, the inner yarn carrier assembly is structured in the relation that the articulating connection rod 452 is provided with the suspending wheel assembly 451, which is suspended on the inner yarn branch rail 13 or the in-air conveying rail 3, the articulating connection rod 452 is used to articulate and connect a plurality of the inner yarn carrier assemblies with each other, the lower part of the articulating connection rod 452 is connected to the hugging arm 455 by means of the vertical bar 453, the opening 4551 is arranged at the bottom of the hugging arm 455, the hugging arm 455 is used to carry the inner yarn winding package 48, and a structure 4552 for placing bobbins is arranged on the hugging arm 455. This structure enables more convenience to load the inner yarn winding package 48 to the hugging arm 455.

As a preferred solution shown in FIG. 10, the inner yarn carrier assembly is structured in the relation that the articulating connection rod 452 is provided with the suspending wheel assembly 451, which is suspended on the inner yarn branch rail 13 or the in-air conveying rail 3, the articulating connection rod 452 is used to articulate and connect a plurality of the inner yarn carrier assemblies with each other, the lower part of the articulating connection rod 452 is connected to the four bar linkage 212 by means of the connecting rod 211, the draw spring 213 is arranged between the two connecting rods approached by the four bar linkage 212 at the bottom, the two connecting rods within the four bar linkage 212 are connected to the first suspending rod 214 and the second suspending rod 215, respectively, and the barbs 216 are arranged on the bottoms of the first suspending rod 214 and the second suspending rod 215.

The draw spring 213 is configured to direct the first suspending rod 214 and the second suspending rod 215 to part from each other. In a preferred solution, a retractable mechanism, such as a steel rope having a winching structure, is arranged on the connecting rod 211. This structure enables the four bar linkage 212 and inner yarn winding package 48 in their entirety to descend, so as to directly be put into the spindle bucket 18. Preferably, the rotary swaying arm 27 is arranged above the spindle bucket 18, and a twister is arranged on the rotary swaying arm 27, so as to dodge the inner yarn winding package 48 by swaying, thereby avoiding hindrance to donning operation.

Figure 5:
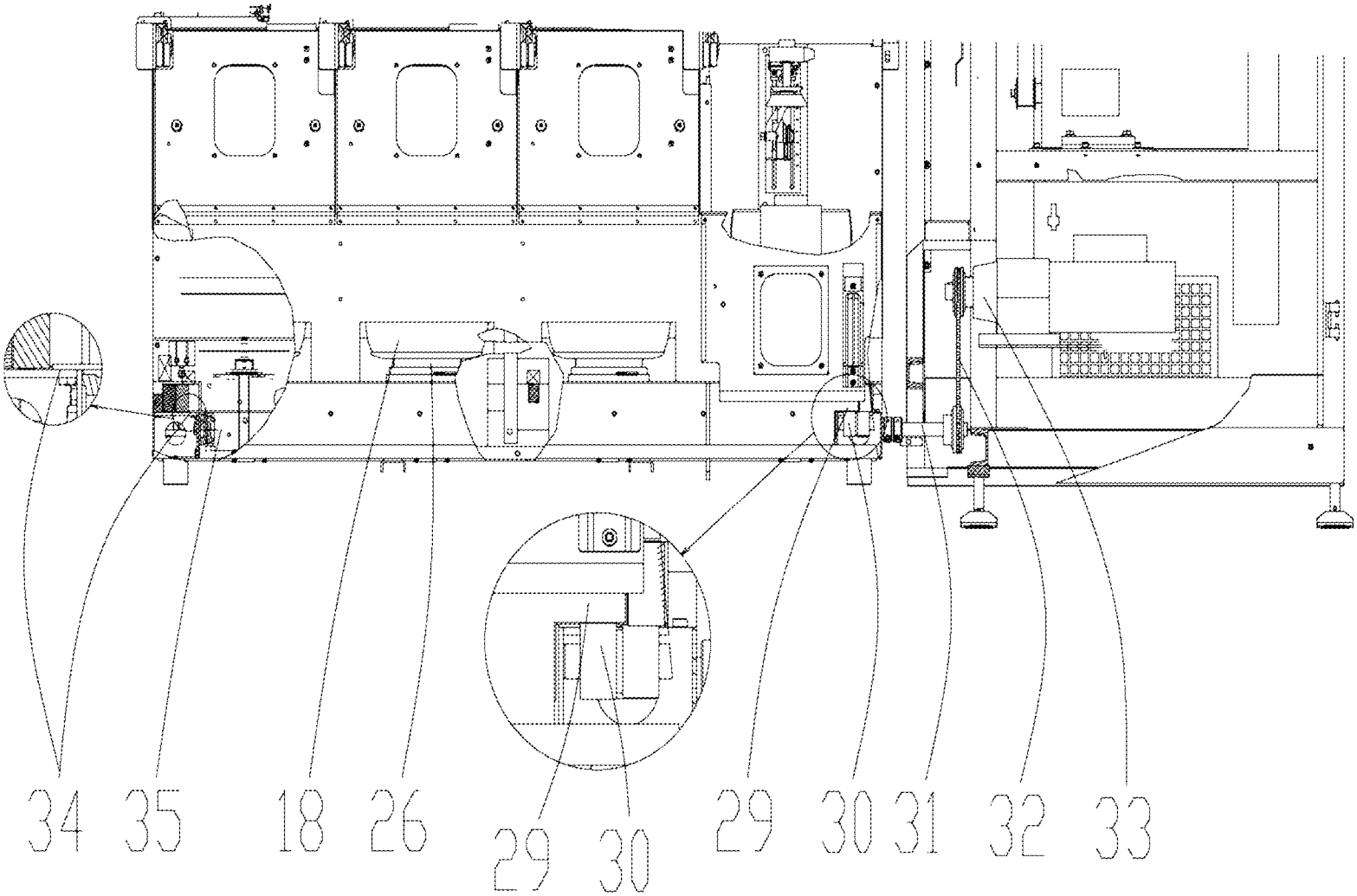
FIG. 5 shows a local front view of the bottom of the twisting machine according to the present disclosure.
Figure 6:
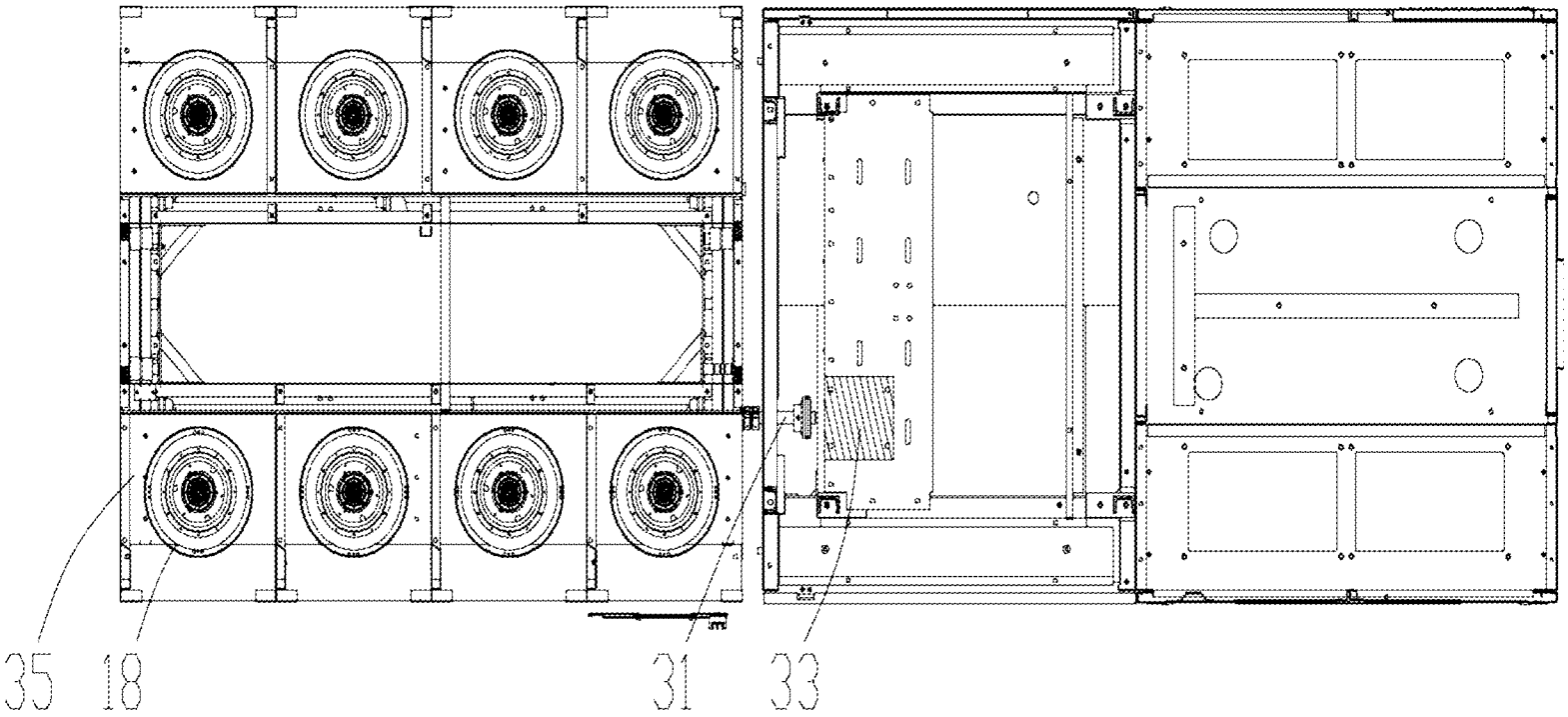
FIG. 6 shows a local top view of the twisting machine according to the present disclosure.
Figure 7:
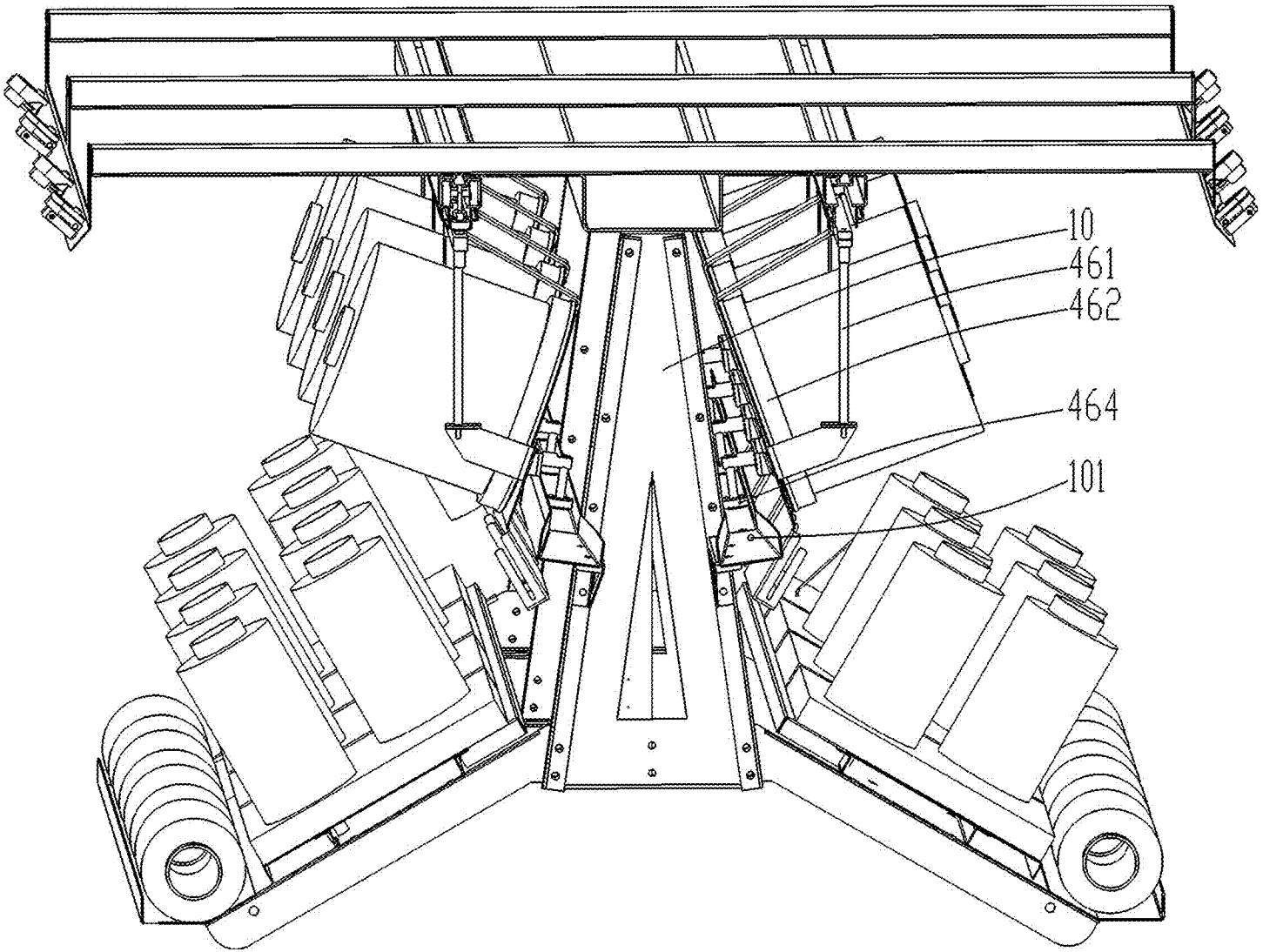
FIG. 7 is a 3D stereogram of the outer yarn seated suspending carrier assembly structure according to the present disclosure.

As a preferred solution shown in FIGS. 4-6, the sliding rail 34 is arranged on the machine frame 10, the sliding frame 35 is slidingly connected with the sliding rail 4, the spindle bucket 18 and the twisting mechanism 26 are arranged on the sliding frame 35, and the sliding frame 35 is configured to slide out from or into one side of the twisting machine 8. This structure enables sharp reduction of the labor intensity for donning the inner yarn winding package 48. A single winding package for some yarn to be twisted weighs more than 10 kg, so it needs very high labor intensity to don yarn massively by manpower. Adopting the structure capable of pulling out the spindle bucket 18 enables the inner yarn winding package 48 to be directly put in it.

As a preferred solution shown in FIG. 6, a driving device is further arranged on the machine frame 10, and the driving device is connected to the sliding main shaft 31 by means of a transmission mechanism and drives the sliding main shaft 31 to rotate; the sliding gear 30 is further arranged on the sliding main shaft 31, the sliding rack 29 is arranged on the sliding frame 35, the sliding rack 29 meshes with the sliding gear 30, so that the sliding frame 35 is configured to slide out from or into one side of the twisting machine 8. This structure enables further reduction of the labor intensity for operators, thus simply on the ascending trolley 17, can operators complete donning operation.

Figure 8:
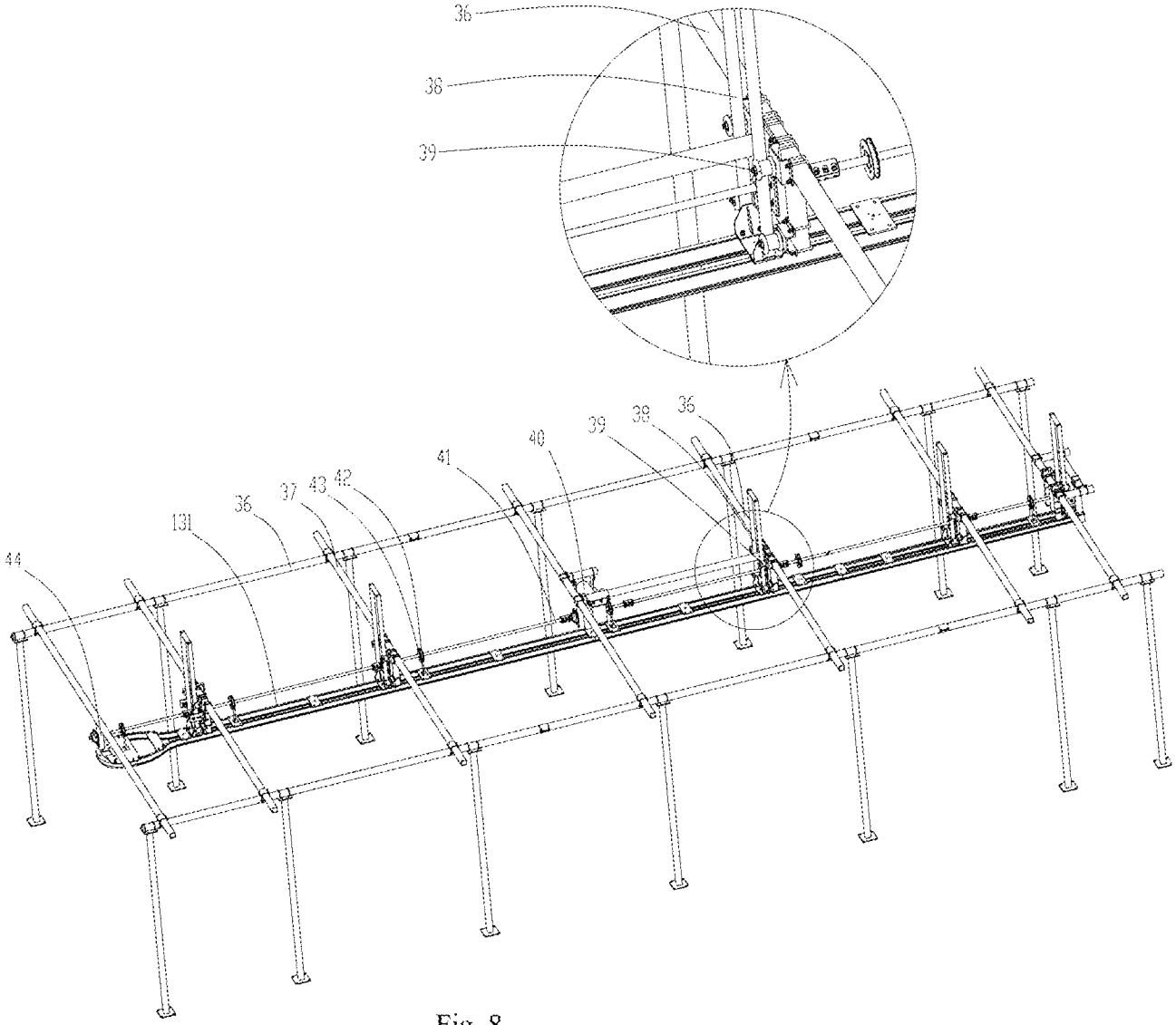
FIG. 8 is a 3D stereogram of the inner yarn branch rail-lifting structure according to the present disclosure.

As a preferred solution shown in FIGS. 1 and 8, the inner yarn branch rail-lifting section 131 capable of ascending and descending is arranged on the inner yarn branch rail 13 corresponding to the twisting machine 8, so that the carrier assembly ascends and descends in its entirety.

The inner yarn branch rail-lifting section 131 is fixedly connected with the lifting rail 38, the lifter guiding wheel 39 is arranged on the supporting frame 36, the lifting rail 38 is slidingly connected with the lifter guiding wheel 39, and there is also the driving device provided, which drives the inner yarn branch rail-lifting section 131 to ascend and descend by means of a transmission mechanism; the transmission mechanism may be a gear rack mechanism, an air cylinder mechanism or a winch mechanism.

There is also the travel sensor 44 provided to detect the ascending and descending distance of the inner yarn branch rail-lifting section 131. This solution enables the ascending and descending distance of the inner yarn winding package 48 to dramatically increase.

The inner yarn carrier assembly is structured in the relation that the articulating connection rod 452 is provided with the suspending wheel assembly 451, which is suspended on the inner yarn branch rail 13 or the in-air conveying rail 3, the articulating connection rod 452 is used to detachably articulate and connect a plurality of the inner yarn carrier assemblies with each other, and the articulating connection rod 452 is connected with the carrier 402 of the inner yarn winding package 48. Preferably, the articulating connection rod 452 has its one end provided with the ball head 456 and its other end provided with the opening groove 457; when two inner yarn carrier assemblies are connected with each other, the ball head 456 is positioned inside the opening groove 457, so that a pull or push force can pass through them. When the inner yarn branch rail-lifting section 131 ascends or descends in its entirety, the ball head 456 can be easily disconnected from or reconnected with the opening groove 457.

In another optional solution, the inner yarn carrier assemblies are connected with each other by the articulating connection rod 452 into an entirety, thus its length corresponds to the length of the twisting machine 8, and the length of the twisting machine 8 also corresponds to the length of the inner yarn branch rail-lifting section 131. This solution enables the inner yarn carrier assemble of the inner yarn branch rail-lifting section 131 to descend and ascend with the latter's descending and ascending.

Preferably, the inner yarn carrier assembly in this example adopts two structures, one is the inner yarn hugging suspending device 45 shown in FIG. 9, and the other is the inner yarn suspending device 21 as shown in FIG. 10. The inner yarn hugging suspending device 45 is high-efficient for loading, and the inner yarn suspending device 21 is convenient for donning operation.

As a preferred solution shown in FIG. 8, the lifting main shaft 41 is arranged on the supporting frame 36, the lifting main shaft 41 rotationally stands on the supporting frame 36, the lifter driving motor 40 is further arranged on the supporting frame 36, the lifter driving motor drives the lifting main shaft 41 to rotate, the winching wheel 42 is further arranged on the lifting main shaft 41, the winching belt 43 is wound on the winching wheel 42, the end of the winching belt 43 is connected with the inner yarn branch rail-lifting section 131, and the winching wheel 42 rotates to drive the inner yarn branch rail-lifting section 131 to ascend and descend. This solution has a simple structure, less requirement to accuracy, for convenience to arrangement and reduction in costs.

Example 2

Figure 11:
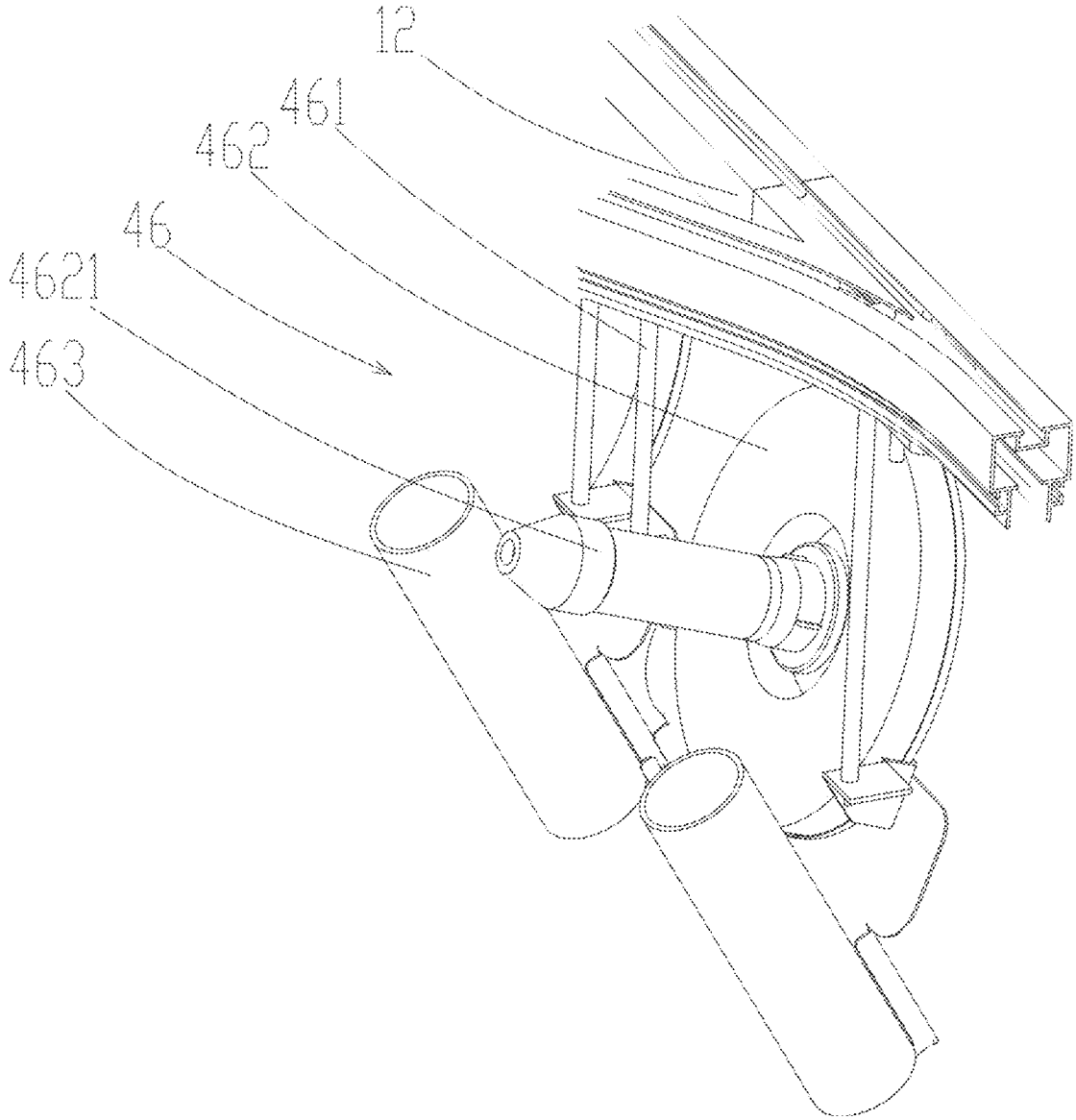
FIG. 11 is a 3D stereogram of the outer yarn seated suspending carrier assembly according to the present disclosure.
Figure 12:
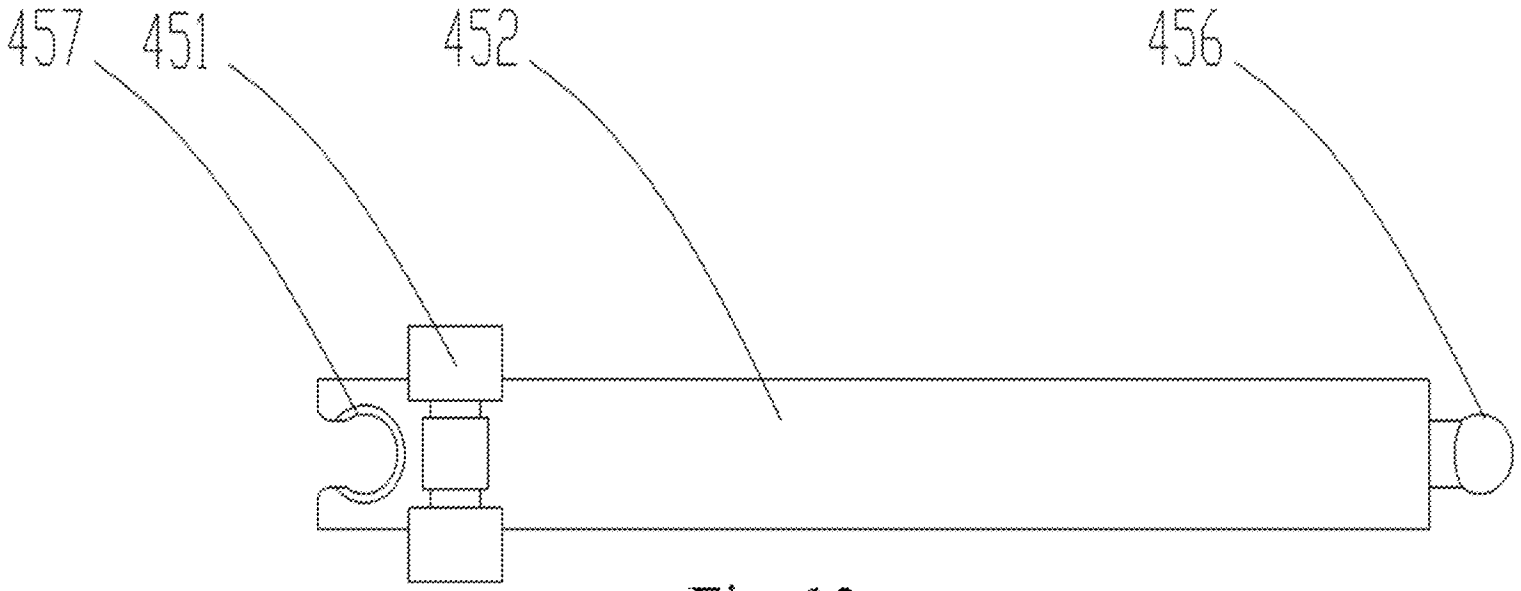
FIG. 12 shows a preferred structure view of the articulating connection rod according to the present disclosure.

As shown in FIGS. 1-13, the outer yarn winding package 47 and the inner yarn winding package 48 are conveyed to the original yarn delivery area 4 by the carrier 402, and then loaded on the outer yarn carrier assembly 25 and the inner yarn carrier assembly in the outer yarn preparation area 1 and the inner yarn preparation area 2, respectively; the articulating connection rod 452 of the outer yarn carrier assembly 25 preferably adopts the pinned articulating connection structure shown in FIG. 9, and the articulating connection rod 452 of the inner yarn carrier assembly preferably adopts the ball head connection structure shown in FIG. 11, and the inner yarn carrier assembly includes the inner yarn hugging suspending device 45 and the inner yarn suspending device 21. The outer yarn carrier assembly 25 and the inner yarn carrier assembly pass through the in-air conveying rail 3, then are conveyed to the outer yarn branch rail 12 and the inner yarn branch rail 13 via the diverging-and-merging switch 6, respectively; the means for conveying and driving may be the travel driving unit 22, which includes an electric motor and a friction wheel, and the friction wheel touches the articulating connection rod 452, and drives it to move. The sort reader 28 is further arranged on the in-air conveying rail 3, it is used to read the information from the outer yarn carrier assembly 25 and the inner yarn carrier assembly, so as to convey them to different positions via the diverging-and-merging switch 6. The outer yarn carrier assemblies 25 are conveyed by group to the position of the twisting machine 8 in the twisting area 5, and form the carriage 11 by temporary fixation. The outer yarn guiding rail 101 is arranged on the machine frame 10, and the outer yarn guiding wheel 464 is arranged on the outer yarn seat 462 in the outer yarn carrier assembly 25, for example, in the outer yarn seated suspending carrier assembly 46; when the outer yarn seated suspending carrier assembly 46 moves to the position of the twisting machine 8, the outer yarn guiding wheel 464 enters the outer yarn guiding rail 101, and holds up the outer yarn seat 462 of the outer yarn seated suspending carrier assembly 46 to keep it in an incline state, for inconvenience to twisting operation. During operation, operators complete connecting yarn on the ascending trolley 17, without necessity to move the outer yarn winding package 47; after finishing twisting operation, operators remove the small-diameter outer yarn winding package 16 and places it on the tube seat 15 of the fixed frame 9, and the bobbin used up on the fixed frame 9 is placed on the shelving plate 14. The travel driving unit 22 conveys the current outer yarn carrier assembly 25 away, then the next outer yarn carrier assembly 25 carrying the outer yarn winding package 47 comes on. The footstep 172 is arranged on the ascending trolley 17, the bottom of which is provided with the ground wheel 171, one side of the bottom of the twisting machine 8 is provided with the ascending trolley guiding rail 19, and the guide pulley mechanism 20 is arranged on the ascending trolley 17, and slidingly connected with the ascending trolley guiding rail 19, so that the ascending trolley 17 can run along the twisting machine 8. A plurality of the inner yarn carrier assemblies of the inner yarn suspending device 21 taken as an example are conveyed to the position of twisting machine 8, the inner yarn branch rail-lifting section 131 descends in its entirety. For a winching lifting device taken as an example in FIG. 8, as the lifter driving motor 40 acts to drive the lifting main shaft 41 to rotate by a gear set, such as a bevel gear set, the winching wheel 42 on the lifting main shaft 41 rotates, so as to release the winching belt 43 from the winching wheel 42, so that the lifting rail 38 of the inner yarn branch rail-lifting section 131 slides along the lifter guiding wheel 39, achieving entire descent. In the inner yarn carrier assemblies positioned at the both sides of the inner yarn branch rail-lifting section 131, such as, the articulating connection rod 452 of the inner yarn suspending device 21, the ball head 456 departs from the opening groove 457; or the length of the entire section of the inner yarn suspending device 21 is equal to that of the inner yarn branch rail-lifting section 131, at descending, the inner yarn suspending device 21 with its entire section descends.

Figure 13:
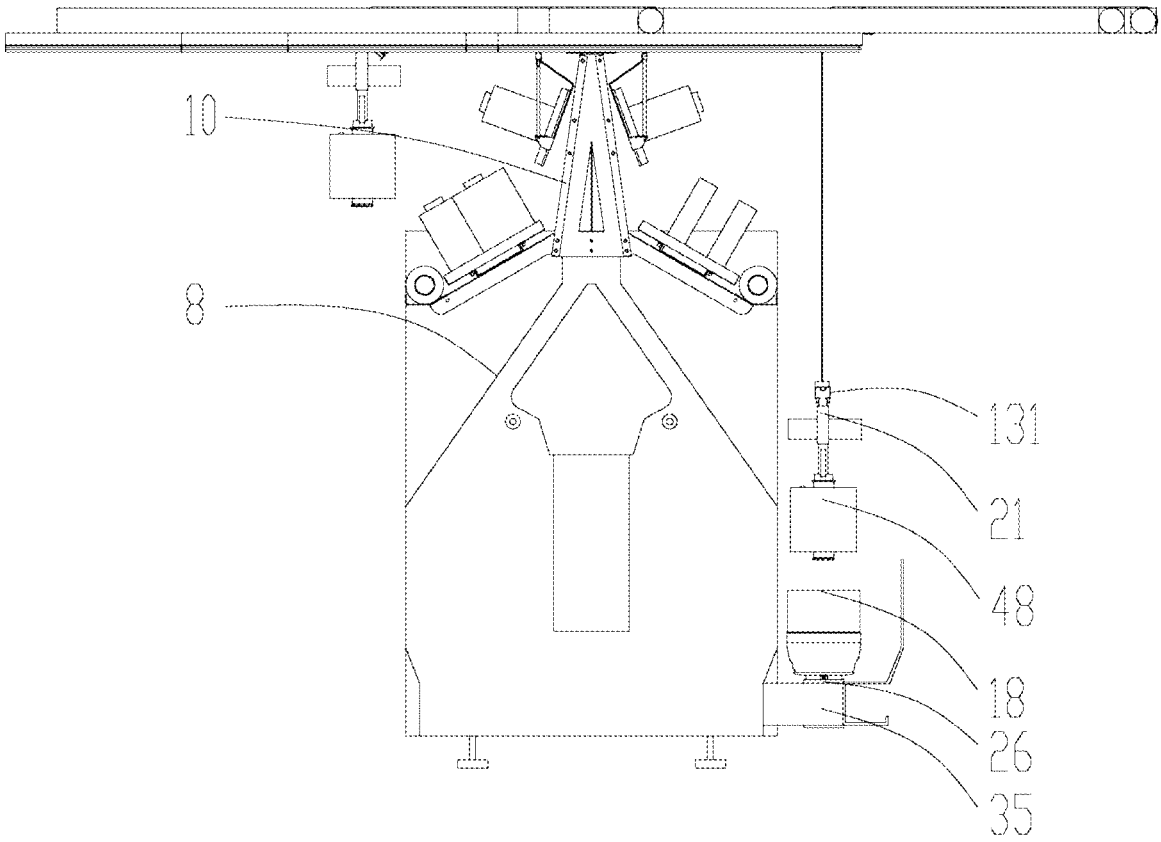
FIG. 13 shows a schematic view in which the inner yarn suspending device conveys the inner yarn winding package into the spindle bucket sliding out sideways according to the present disclosure.

Moreover, as shown in FIGS. 4-6, the driving device 33 drives the sliding main shaft 31 to rotate by the transmission mechanism 32, the sliding main shaft 31 brings the sliding gear 30 to rotation, the sliding gear 30 brings the sliding rack 29 to action, the sliding rack 29 is fixed on the sliding frame 35, so that the sliding frame 35 brings the spindle bucket 18 and the twisting mechanism 26 to sliding movement out from the twisting machine 8, and the twisting mechanism 26 includes an electric spindling assembly. As shown in FIG. 13, this structure enables the inner yarn suspending device 21 to move to the above position of the spindle bucket 18 and the inner yarn winding package 48 on the inner yarn suspending device 21 to be directly loaded into the spindle bucket 18 by pressing the four bar linkage 212. Either of the structure of the sliding frame 35 and the structure of the rotating swing arm 27 is selectable, that is, one of both can be used; the structure of the sliding frame 35 brings about low labor intensity, but costs increase more for the twisting machine 8. The driving device 33 acts again, so that the sliding frame 35 slides back to the twisting machine 8, and the forementioned steps enables the twisting machine to complete automatic donning. After completing donning, the lifter driving motor 40 acts, so that the inner yarn branch rail-lifting section 131 ascends in its entirety. In the inner yarn carrier assemblies positioned at the both sides of the inner yarn branch rail-lifting section 131, such as, the articulating connection rod 452 of the inner yarn suspending device 21, the ball head 456 is connected with the opening groove 457 again. The travel driving unit 22 acts again, then conveys the inner yarn carrier assembly carrying a new inner yarn winding package 48 to the position of the twisting machine 8.

The above embodiments are only preferred technical solutions of the present disclosure, and should not be regarded as limiting the present disclosure. The embodiments in the present application and the features in the embodiments can be arbitrarily combined with each other without conflict. The scope of protection of the present disclosure shall be the technical solutions recorded in the claims, including the equivalent alternatives of the technical features in the technical solutions recorded in the claims. Equivalent substitutions and improvements in the scope are also included in the scope of protection of the present disclosure.

What is claimed is:

1. A twisting machine and rail system for automatic donning, comprising an outer yarn branch rail (12) and an inner yarn branch rail (13), wherein said outer yarn branch rail (12) is arranged at the middle position of the twisting machine (8), and is used to successively drive an outer yarn carrier assembly (25) to carry a suspended outer yarn winding package (47);

said inner yarn branch rail (13) is arranged at the both sides of the twisting machine (8), and is used to successively drive an inner yarn carrier assembly to carry a suspended inner yarn winding package (48) which is configured closer to the twisting machine (8) than the outer yarn winding package (47);

wherein the outer yarn carrier assembly (25) is an outer yarn seated suspending carrier assembly (46), in the outer yarn seated suspending carrier assembly (46), an articulating connection rod (452) is provided with a suspending wheel assembly (451), which is suspended on said outer yarn branch rail (12) or an in-air conveying rail (3), the articulating connection rod (452) is used to articulate and connect a plurality of the outer yarn carrier assemblies (25) with each other, the lower part of the articulating connection rod (452) is connected to a disc-shaped outer yarn seat (462), the outer yarn seat (462) is arranged obliquely in a vertical direction, and a columnar structure (4621) used to mount the outer yarn winding package (47) is arranged on the outer yarn seat (462);

both lateral sides of a vertical surface passing through a center of the outer yarn seat (462) are correspondingly provided with outer yarn suspending frames (461), the outer yarn suspending frames (461) are provided at corresponding positions relative to the center of the outer yarn seat (462), the outer yarn suspending frames (461) are connected with the articulating connection rod (452), and bobbin bases (463) are further correspondingly arranged on the both lateral sides;

wherein an outer yarn guiding rail (101) is arranged on a machine frame (10) of the twisting machine (8), and an outer yarn guiding wheel (464) is arranged on an outer yarn seat (462); when the outer yarn seated suspending carrier assembly (46) moves to a position of the twisting machine (8), the outer yarn guiding wheel (464) enters the outer yarn guiding rail (101), and raises up the outer yarn seat (462) of the outer yarn seated suspending carrier assembly (46) to keep the outer yarn seat (462) in an incline state and to enable a balance of the outer yarn seat (462);

when the outer yarn carrier assembly (25) moves to a corresponding work station of the twisting machine (8), the outer yarn carrier assembly (25) is used to carry the outer yarn winding package (47) for twisting operation.

2. The twisting machine and rail system for automatic donning according to claim 1, wherein a yarn shelving plate (14) is further arranged on the machine frame (10) of the twisting machine (8), and said shelving plate (14) is used to place the outer yarn winding package (47) that has been used once;

a fixed frame (9) is further arranged on the machine frame (10), a tube seat (15) is arranged on the fixed frame (9), and the outer yarn winding package (47) that has been used once is sleeved on the tube seat (15).

3. The twisting machine and rail system for automatic donning according to claim 1, wherein the inner yarn carrier assembly is structured in the relation that an inner articulating connection rod (452) is provided with an inner suspending wheel assembly (451), which is suspended on said inner yarn branch rail (13) or an inner in-air conveying rail (3), the inner articulating connection rod (452) is used to articulate and connect a plurality of the inner yarn carrier assemblies with each other, the lower part of the inner articulating connection rod (452) is connected to a hugging arm (455) by means of a vertical bar (453), an opening (4551) is arranged at the bottom of the hugging arm (455), the hugging arm (455) is used to carry the inner yarn winding package (48), and a structure (4552) for placing bobbins is arranged on the hugging arm (455).

4. The twisting machine and rail system for automatic donning according to claim 1, wherein the inner yarn carrier assembly is structured in the relation that an inner articulating connection rod (452) is provided with an inner suspending wheel assembly (451), which is suspended on said inner yarn branch rail (13) or an inner in-air conveying rail (3), the inner articulating connection rod (452) is used to articulate and connect a plurality of the inner yarn carrier assemblies with each other, the lower part of the inner articulating connection rod (452) is connected to a four bar linkage (212) by means of a connecting rod (211), a draw spring (213) is arranged between two connecting rods of the four bar linkage (212), other two connecting rods of the four bar linkage (212) are connected to a first suspending rod (214) and a second suspending rod (215), respectively, and barbs (216) are arranged on bottoms of the first suspending rod (214) and the second suspending rod (215);

the draw spring (213) is configured to direct the first suspending rod (214) and the second suspending rod (215) to part from each other.

5. The twisting machine and rail system for automatic donning according to claim 1, wherein a sliding rail (34) is arranged on the machine frame (10), a sliding frame (35) is slidingly connected with the sliding rail (34), a spindle bucket (18) and a twisting mechanism (26) are arranged on the sliding frame (35), and the sliding frame (35) is configured to slide out from or into one side of the twisting machine (8).

6. The twisting machine and rail system for automatic donning according to claim 5, wherein a driving device (400) is further arranged on the machine frame (10), and the driving device (400) is connected to a sliding main shaft (31) by means of a transmission mechanism and drives the sliding main shaft (31) to rotate; a sliding gear (30) is arranged on the sliding main shaft (31), a sliding rack (29) is arranged on the sliding frame (35), the sliding rack (29) meshes with the sliding gear (30), so that the sliding frame (35) is configured to slide out from or into one side of the twisting machine (8).

7. The twisting machine and rail system for automatic donning according to claim 1, wherein an inner yarn branch rail-lifting section (131) capable of ascending and descending is arranged on said inner yarn branch rail (13) corresponding to the twisting machine (8), so that the inner yarn carrier assembly ascends and descends in its entirety;

the inner yarn branch rail-lifting section (131) is fixedly connected with a lifting rail (38), a lifter guiding wheel (39) is arranged on a supporting frame (36), the lifting rail (38) is slidingly connected with the lifter guiding wheel (39), and there is also a driving device (400) provided, which drives the inner yarn branch rail-lifting section (131) to ascend and descend by means of a transmission mechanism (401), and the transmission mechanism (401) includes a gear rack mechanism, an air cylinder mechanism or a winch mechanism;

there is also a travel sensor (44) provided to detect an ascending and descending distance;

the inner yarn carrier assembly is structured in the relation that an inner articulating connection rod (452) is provided with an inner suspending wheel assembly (451), which is suspended on said inner yarn branch rail (13) or an inner in-air conveying rail (3), the inner articulating connection rod (452) is used to detachably articulate and connect a plurality of the inner yarn carrier assemblies with each other, and the inner articulating connection rod (452) is connected with a carrier (402) of the inner yarn winding package (48).

8. The twisting machine and rail system for automatic donning according to claim 1, wherein an inner yarn branch rail-lifting section (131) capable of ascending and descending is arranged on said inner yarn branch rail (13) corresponding to the twisting machine (8), so that the inner yarn carrier assembly ascends and descends accordingly;

the inner yarn branch rail-lifting section (131) is fixedly connected with a lifting rail (38), a lifter guiding wheel (39) is arranged on a supporting frame (36), and the lifting rail (38) is slidingly connected with the lifter guiding wheel (39); a lifting main shaft (41) is arranged on the supporting frame (36), a lifter driving motor (40) is further arranged on the supporting frame (36), the lifter driving motor (40) drives the lifting main shaft (41) to rotate, a winching wheel (42) is further arranged on the lifting main shaft (41), a winching belt (43) is wound on the winching wheel (42), the end of the winching belt (43) is connected with the inner yarn branch rail-lifting section (131), and the winching wheel (42) rotates to drive the inner yarn branch rail-lifting section (131) to ascend and descend.

9. A twisting machine and rail system for automatic donning, comprising an outer yarn branch rail (12) and an inner yarn branch rail (13), wherein said outer yarn branch rail (12) is arranged at the middle position of the twisting machine (8), and is used to successively drive an outer yarn carrier assembly (25) to carry a suspended outer yarn winding package (47);

said inner yarn branch rail (13) is arranged at the both sides of the twisting machine (8), and is used to successively drive an inner yarn carrier assembly to carry a suspended inner yarn winding package (48) which is configured closer to the twisting machine (8) than the outer yarn winding package (47);

wherein the outer yarn carrier assembly (25) comprises outer yarn suspending frames (461), a plurality of disc-shaped outer yarn seats (462) and bobbin bases (463), wherein, an articulating connection rod (452) is provided with a suspending wheel assembly (451), which is suspended on said outer yarn branch rail (12) or an in-air conveying rail (3), the articulating connection rod (452) is used to articulate and connect a plurality of the outer yarn carrier assemblies (25) with each other, the lower part of the articulating connection rod (452) is connected to the plurality of disc-shaped outer yarn seats (462), each of the plurality of outer yarn seats (462) is arranged obliquely in a vertical direction, and a columnar structure (4621) used to mount the outer yarn winding package (47) is arranged on each of the plurality of outer yarn seats (462);

both lateral sides of a vertical surface passing through a center of each of the plurality of outer yarn seats (462) are respectively provided with the outer yarn suspending frames (461), the outer yarn suspending frames (461) are connected with the articulating connection rod (452), and the bobbin bases (463) are further respectively arranged on the both lateral sides of each of the plurality of outer yarn seats (462);

wherein an outer yarn guiding rail (101) is arranged on a machine frame (10) of the twisting machine (8), and an outer yarn guiding wheel (464) is arranged on at least one of the plurality of outer yarn seats (462);

when the outer yarn carrier assembly (25) moves to a position of the twisting machine (8), the outer yarn guiding wheel (464) enters the outer yarn guiding rail (101), and raises up the plurality of outer yarn seats (462) of the outer yarn carrier assembly (25) to keep the plurality of outer yarn seats (462) in an incline state and to enable a balance of the plurality of outer yarn seats (462);

when the outer yarn carrier assembly (25) moves to a corresponding work station of the twisting machine (8), the outer yarn carrier assembly (25) is used to carry the outer yarn winding package (47) for twisting operation.

* * * * *